US006244190B1

(12) United States Patent
Sembtner et al.

(10) Patent No.: US 6,244,190 B1
(45) Date of Patent: Jun. 12, 2001

(54) TILTING MECHANISM

(75) Inventors: Roger Sembtner, Stuttgart; Bernd Stehlin, Leinfelden-Echterdingen, both of (DE)

(73) Assignee: Moog GmbH, Boeblingen (DE)

( * ) Notice: Subject to any disclaimer, the term of this patent is extended or adjusted under 35 U.S.C. 154(b) by 0 days.

(21) Appl. No.: 09/168,539

(22) Filed: Oct. 8, 1998

(30) Foreign Application Priority Data

Oct. 9, 1997 (EP) ..... 97117513

(51) Int. Cl.[7] ..... B61F 5/00

(52) U.S. Cl. ..... 105/199.2; 105/199.1; 280/124.103; 280/5.509

(58) Field of Search ..... 105/199.2; 280/124.103, 280/5.509

(56) References Cited

U.S. PATENT DOCUMENTS 3,717,104 * 2/1973 Law et al. ..... 105/199.2
4,503,504 * 3/1985 Suzumura et al. ..... 364/425
5,116,069 * 5/1992 Miller ..... 280/112.2
5,222,440 * 6/1993 Schneider ..... 105/199.1

FOREIGN PATENT DOCUMENTS 7-81563 3/1995 (JP) .
9-86408 3/1997 (JP) .

* cited by examiner

*Primary Examiner*—S. Joseph Morano
*Assistant Examiner*—Frantz F. Jules
(74) *Attorney, Agent, or Firm*—Phillips, Lytle, Hitchcock, Blaine & Huber LLP

(57) ABSTRACT

The invention refers to a tilting mechanism for creating track curve-dependent tilt of the superstructure of rail vehicles (1), consisting of a coupling (15) with which the superstructure (2) is movably connected to a bogie (3) in such a way that the superstructure can be transferred from an upright initial position into a tilted position relative to the bogie and having a drive (31) and an transfer mechanism including a transfer mechanism by which means the superstructure can be movably transferred from its initial position into its tilted position relative to the bogie. To be able to manufacture such tilting mechanism in a more inexpensive way, the invention aims at equipping the transfer mechanism with a mechanism with a variable transmission, the transmission of the mechanism increasing with increasing inclination angle of the superstructure relative to the bogie during transfer of the superstructure from its initial position into its tilted position.

13 Claims, 7 Drawing Sheets

TILTING MECHANISM

FIELD OF THE INVENTION

The present invention relates to a tilting mechanism for enabling curved track-dependent tilting of the superstructure of a rail vehicle, and, more particularly, to a coupling means movably connecting the superstructure with a bogie in such a way that the superstructure can be brought from an upright initial position into a tilted position relative to the bogie.

BACKGROUND ART

Tilting mechanisms are known in the prior art. They are used in "tilting trains". These are specially designed passenger trains, their design enabling their superstructure to be turned or "tilted" around its longitudinal axis relative to a bogie. This tilting process aims at compensating the horizontal acceleration acting upon the passengers in curves. Despite a considerable improvement of cruising comfort for the passengers, the curved tracks can be traveled much faster than allowed for normal trains by the EBO (German Rules for the Construction and Operation of rail vehicles), thus enabling the passengers to reach their destination much faster over winding railroad routes.

Such tilting mechanisms are subdivided into active and passive systems. Passive systems enable a tilting of the superstructure only as a result of centrifugal forces acting upon the superstructure. The tilting angle of such systems is, however, very limited, with maximum inclination angles of 1.2 to 3.5 degrees, depending on the design. Active systems make use of an adjusting means by which the tilting between the superstructure and the bogie can be controlled via a control loop, depending on the track curve and/or the velocity. These systems are generally suitable for a maximum inclination angle of approximately 8 degrees. This invention refers to such an active tilting mechanism.

In the known systems, the adjusting means either consists of a hydraulic servo cylinder or an electromechanical linear drive. The electromechanical linear drive, for example, is designed as a combination of an electromotor and a planet roller spindle. The adjusting means is located between the superstructure and the bogie.

It is known from the tilting trains in operation that an actuator force ranging from 8 to 10 tons is installed at each of the two bogies. Values this high are needed if the superstructure is to be held in its maximum excursion position of 8 degrees, since the center of gravity of the superstructure, in the case of large inclination angles, acts via a relatively large lever arm in the sense of a restoring torque. Forces this high are necessary to enable the superstructure to automatically return to its untilted initial position in case of a default of the tilting mechanism.

The design of the linear drive depends on the largest forces becoming active at a maximum angle of inclination. Furthermore, a relation between actuator force and the required torque at the motor exists for the known electromechanical actuators. In case of such a drive, it means that, for producing the necessary force, a current in the servo motor is necessary, its strength being also proportional to the angle of inclination. Since it is known that the stray power in a motor increases with the square of the engine current, this results in a considerably high stray power if the superstructure inclination is moving at high excursion angles.

This leads to the fact that the electromotor as well as the power electronics supplying it with electricity have to be designed for high levels of permanent power, naturally influencing the cost of acquisition of the mechanism. Furthermore, the dimensions of the drive have a major influence on the required space for installation. For larger drive motors, this installation space has to be sufficiently large.

Hence, it would be useful to create an actuator for the track curve-dependent control of a superstructure not characterized by the disadvantages described above with respect to the stray power occurring during operation at large inclination angles, and being additionally designed in a more compact and cost-efficient way.

DISCLOSURE OF THE INVENTION

With reference to the corresponding parts, portions, or surfaces of the disclosed embodiment, merely for the purpose of illustration and not by way of limitation, the present invention solves the problems found in the prior art by providing a transfer means with a mechanism with variable transmission, the transmission of the mechanism increasing with the increasing angle of inclination of the superstructure relative to the bogie when transferring the superstructure from its initial position into a tilted position.

This solution has the advantage that a larger transmission is provided in case of increasing inclination forces, thus making a considerably smaller dimensioned drive sufficient to cope with larger forces. Consequently, the transmission is lower at smaller angles of inclination and increases with increasing angles of inclination. A smaller transmission at smaller angles of inclination is desirable, thus reducing the gear losses and enabling small actuator forces to safely bring the superstructure into the untilted initial position. Since a smaller drive with respect to the required permanent power is sufficient at comparable forces based on the angle of inclination, this has an influence on the drive itself as well as on the power electronics and the wiring, thus enabling a more inexpensive design of the tilting mechanism. A smaller drive also requires less installation space.

In an advantageous development of the invention, the mechanism could include a crankshaft, consisting of a crank pin being displaced radially to the crankshaft and a drawbar and/or side rod pivotably connected to the crank pin. With such a gear, a considerable transmission ratio can be easily realized for variable gear ratios. In particular, in case of an almost aligned crank mechanism, almost any large transmission can be realized.

The advantage resulting from a high gear transmission at large angles of inclination has a major effect on electromotor drives withstanding large actuator forces. In the case of electromotor drives, the stray power is mainly influenced by the transmission of engine torques and not by the adjusting velocity, as is the case with hydraulic linear actuators. On the other hand, electromotors are also considered to have an advantage over hydraulic or pneumatic drive units in that they need not be maintained so often, are easily available, have lower life cycle cost, are more easily mountable and consume less energy, thus being very environment-friendly.

Moreover, a gear between the mechanism and the drive motor can be of the reduction type. The result is that even small electromotors can create the necessary active forces and/or transverse forces to bring the superstructure from its initial position to its tilted position.

It can be advantageous to connect an electromotor with the reduction gear and/or crank mechanism by means of an universal joint. In doing so, the electromotor can be installed in a more advantageous position, thus enabling a more compact design of the tilting mechanism.

As an alternative, the motor could also be connected to the reduction gear and/or to the crank mechanism by means of a belt drive or a chain drive. Also, in this case, the tilting mechanism can be designed in a compact way by installing the motor in a suitable space distant from the reducing gear.

In a preferred embodiment, a line through the center of the crankshaft and the crank pin and a line through the center of the crank pin and the position of the bearing of the drawbar and/or side rod located distant to the crank pin can basically form a right angle in the initial position of the superstructure. This results in a particularly favorable force progression when initially bringing the superstructure from its initial position into a tilted position.

Extremely large inclination forces can be obtained if the crank mechanism is almost straight at a maximum inclination angle.

These and other objects and advantages will become apparent from the foregoing and ongoing written specification, the drawings, and the appended claims.

DESCRIPTION OF THE PREFERRED EMBODIMENTS

Figure 9:
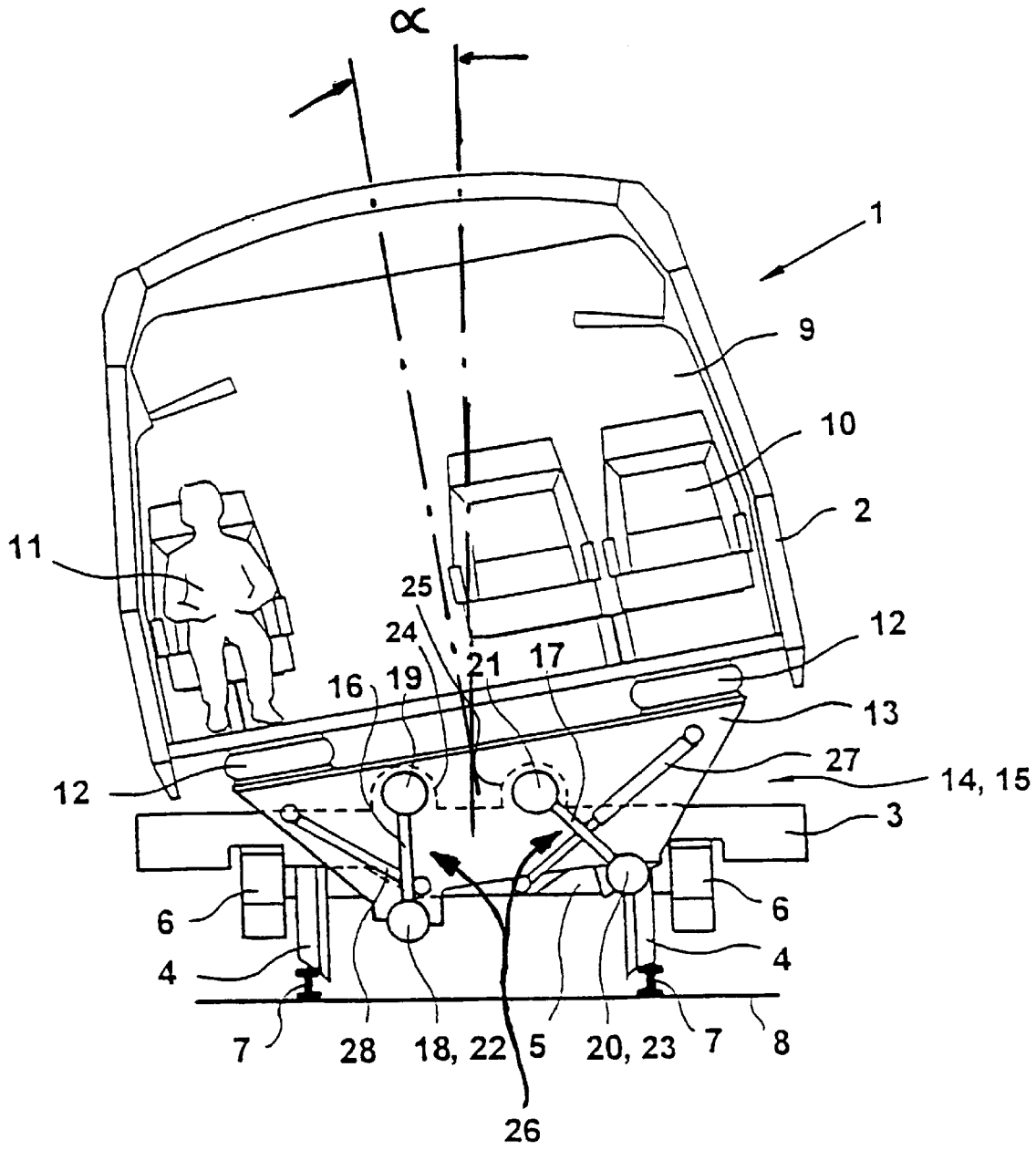
FIG. 9 PRIOR ART
FIG. 9 is a tilting mechanism known in the prior art.

FIG. 9 shows a cross section of a passenger train 1, or a track vehicle, with a superstructure 2 and a bogie 3. The bogie 3 includes track wheels 4 being linked to one another by an axis 5 and running in bearings 6 of the bogie 3. The track wheels 4 are running on schematically shown tracks 7 attached to a base 8. The superstructure 2 includes an interior space 9 in which seats 10 are arranged. A person 11 is shown in schematic view sitting on one of the seats 10.

The superstructure 2 consists of a secondary suspension system 12, the suspension elements of which are shown in schematic view. The suspension system 12 is arranged between the superstructure 2 and a carrier element 13 belonging to the superstructure 2. Instead of a suspension system 12, the carrier element 13 may be directly and rigidly connected to superstructure 2 or be part of the superstructure 2, respectively.

A tilting mechanism 14 is located between superstructure 2 and bogie 3. This tilting mechanism includes a coupling means 15, mainly consisting of a four-bar-mechanism. The four-bar-mechanism is formed by joint rods 16 and 17, each joint rod having ends 18 and 19 and 20 and 21, respectively. These ends form bearing positions. Each end 18 to 21 is pivotally located in swivel fixed pivot brackets 22 to 25, the swivel fixed pivot brackets 22 and 23 being mounted onto the superstructure 2 and each swivel fixed pivot bracket 24 and 25 being fixedly mounted onto the bogie 3.

The swivel fixed pivot brackets 22 to 25 are arranged in such a way that the ends 18 and 20 of the joint rods 16 and 17 are located further apart from one another than the ends 19 and 21 of the joint rods 16 and 17. Also the swivel fixed pivot brackets 22 and 23 of the superstructure are arranged underneath the swivel fixed pivot brackets 24 and 25 of the bogie, thus forming a four-bar-mechanism allowing the superstructure 2 to be pivoted relative to the bogie 3.

The center of gravity S of the superstructure 2 is located underneath the rotation axis P of the four-bar-mechanism. This enables the superstructure 2 to automatically stabilize itself in a initial position in which it is mainly vertically arranged on the bogie 3. In FIG. 9, the superstructure 2 is tilted at an inclination angle $\alpha$ relative to the bogie 3 or is in its tilted position, respectively. The maximum inclination angle $\alpha$ amounts to approximately 8 degrees as shown in the embodiment on file.

An adjusting means 26 is located between bogie 3 and the superstructure 2, or several adjusting means 26 can be present, respectively. This adjusting means 26 supports itself on superstructure 2 and bogie 3. In the prior art depicted in FIG. 9, this adjusting means consists of hydraulic cylinders 27 and 28. By means of respective expansion or shortening of the hydraulic cylinder, the superstructure 2 can be tilted relative to the bogie 3.

Figure 10:
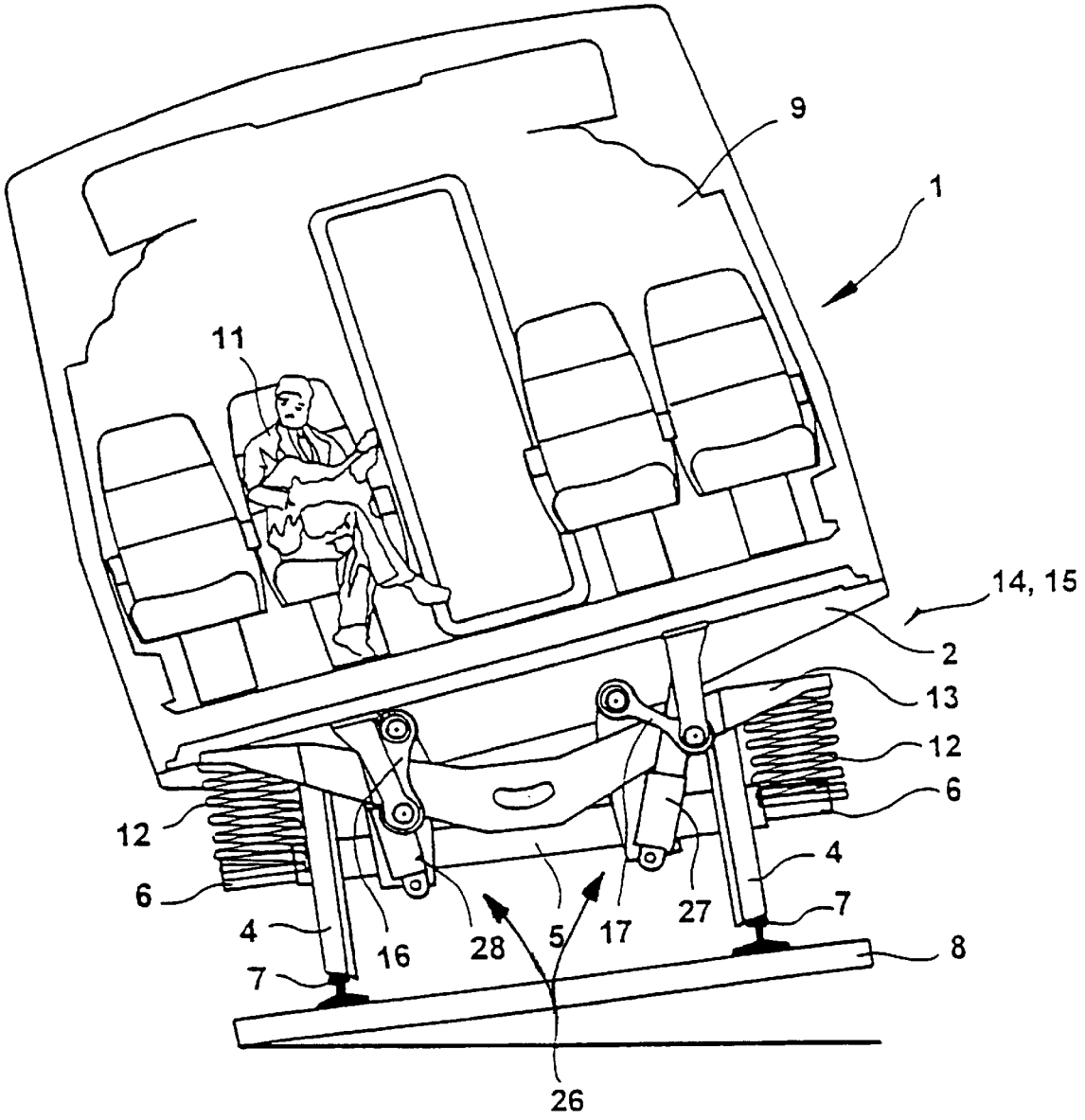
FIG.10 PRIOR ART
FIG. 10 is a tilting mechanism known in the prior art.

A second embodiment taken from the prior art is depicted in FIG. 10, in which hydraulic cylinders 27 and 28 serve as an adjusting means 26 as well. In contrast to the first embodiment from the prior art, the secondary suspension system 12 is arranged on the bogie 3, the carrier element 13 this time supporting itself on the axis bearings 6.

Figure 11:
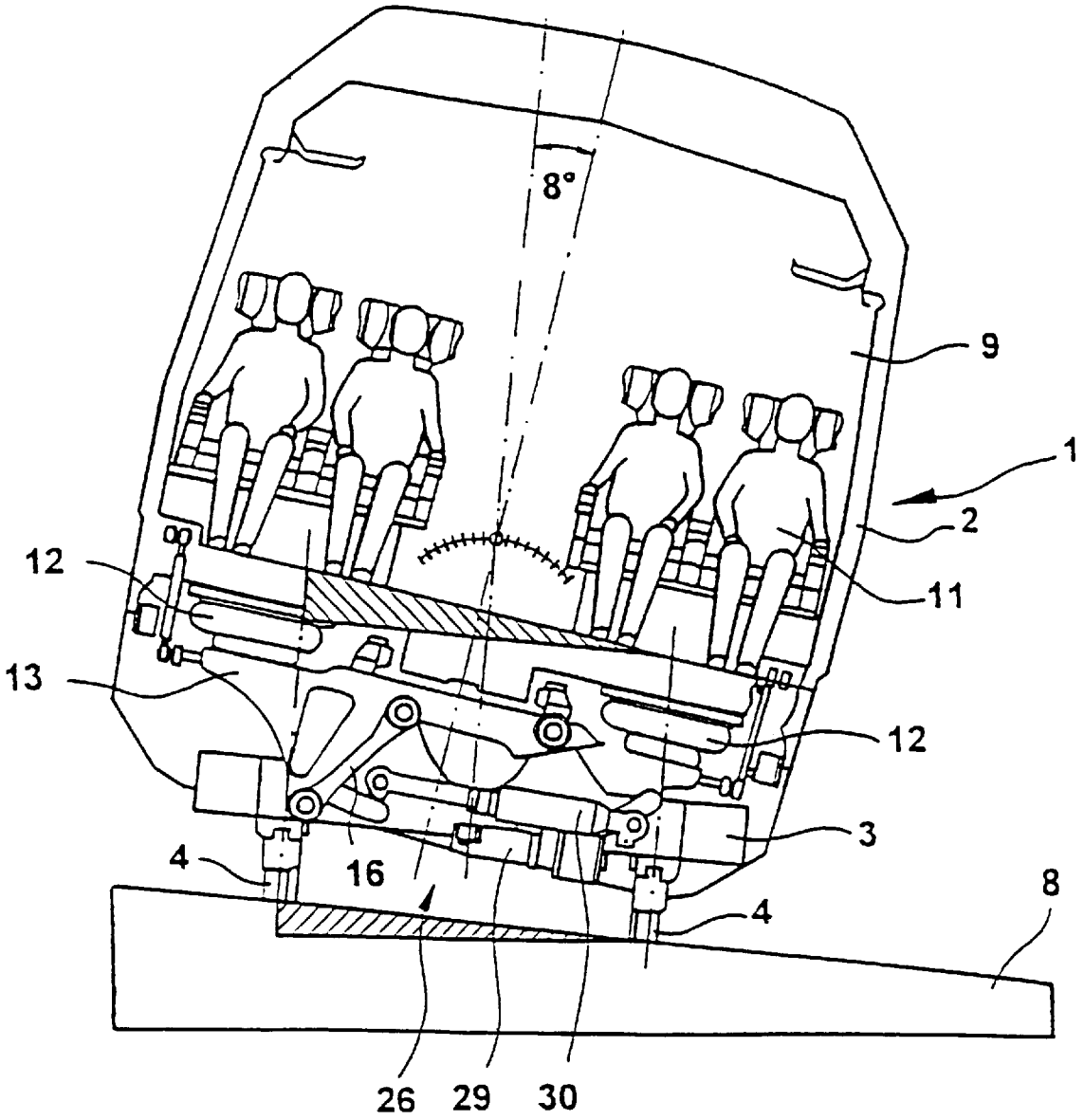
FIG.11 PRIOR ART
FIG. 11 is a tilting mechanism known in the prior art.

In a third embodiment shown in FIG. 11 of the prior art, electric linear actuators 29 and 30 are being used instead of hydraulic cylinders. By expanding or shortening the actuators 29 and 30, adjusting or tilting of the superstructure 2 relative to the bogie is made possible.

Figure 1:
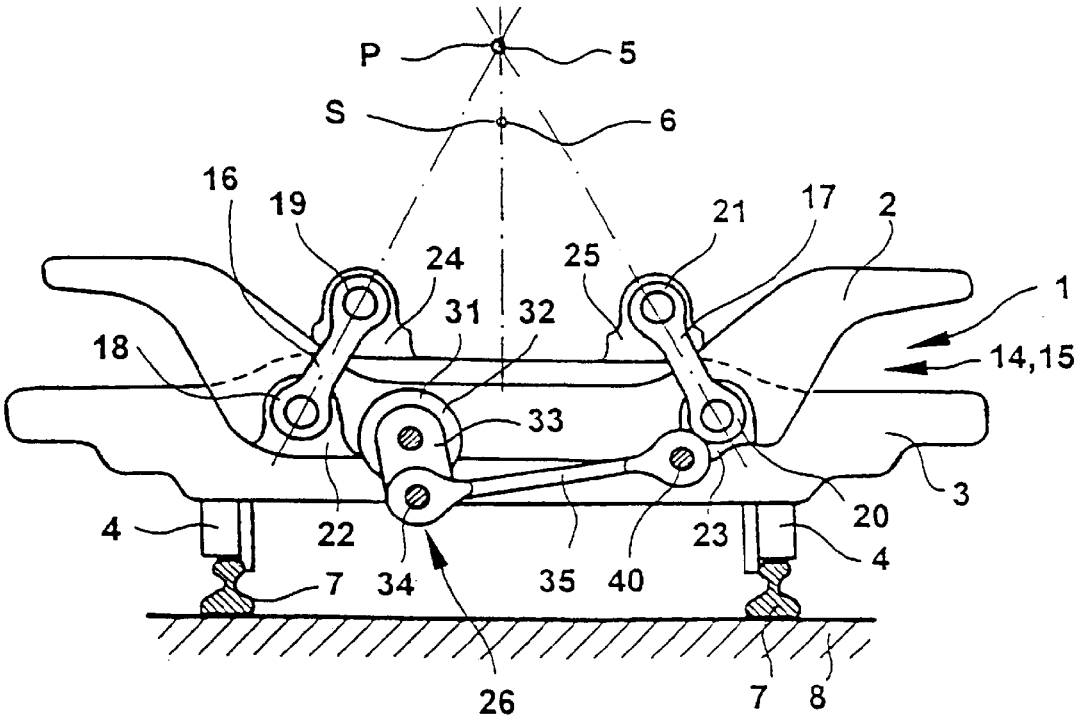
FIG. 1 is a schematic view of the tilting mechanism, showing the superstructure in its initial position.
Figure 2:
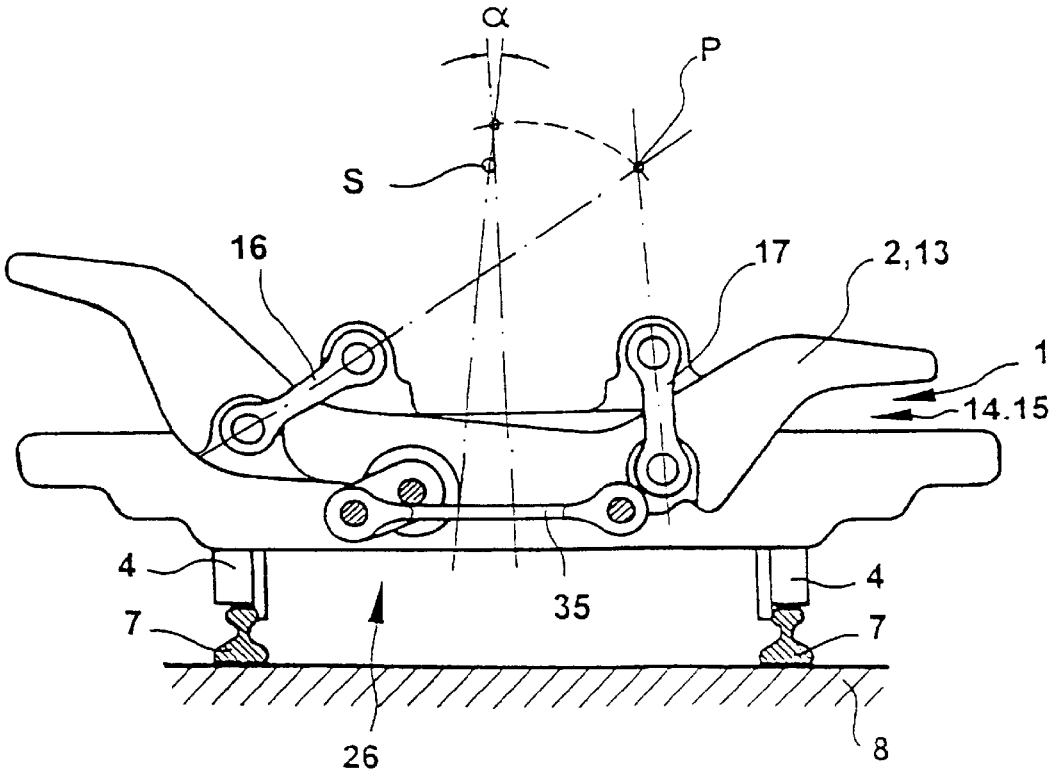
FIG. 2 is a schematic view of the tilting mechanism shown in FIG. 1, in which the superstructure is in a tilted position.
Figure 3:
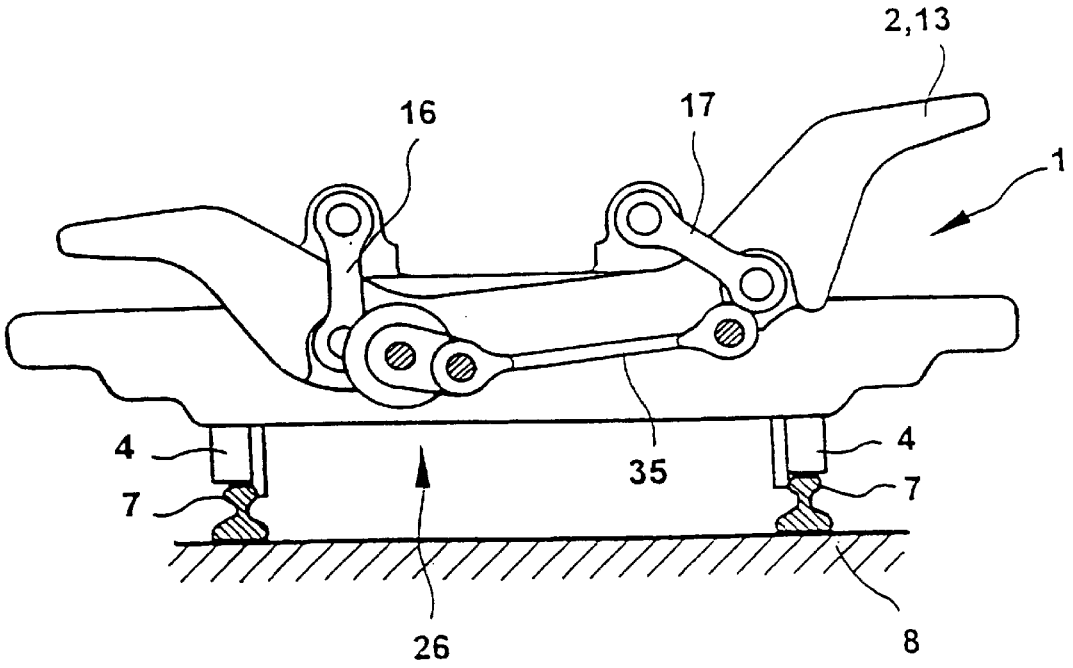
FIG. 3 is a schematic of the tilting mechanism shown in FIG. 2, in which the superstructure is tilted in the opposite direction to FIG. 2.
Figure 4:
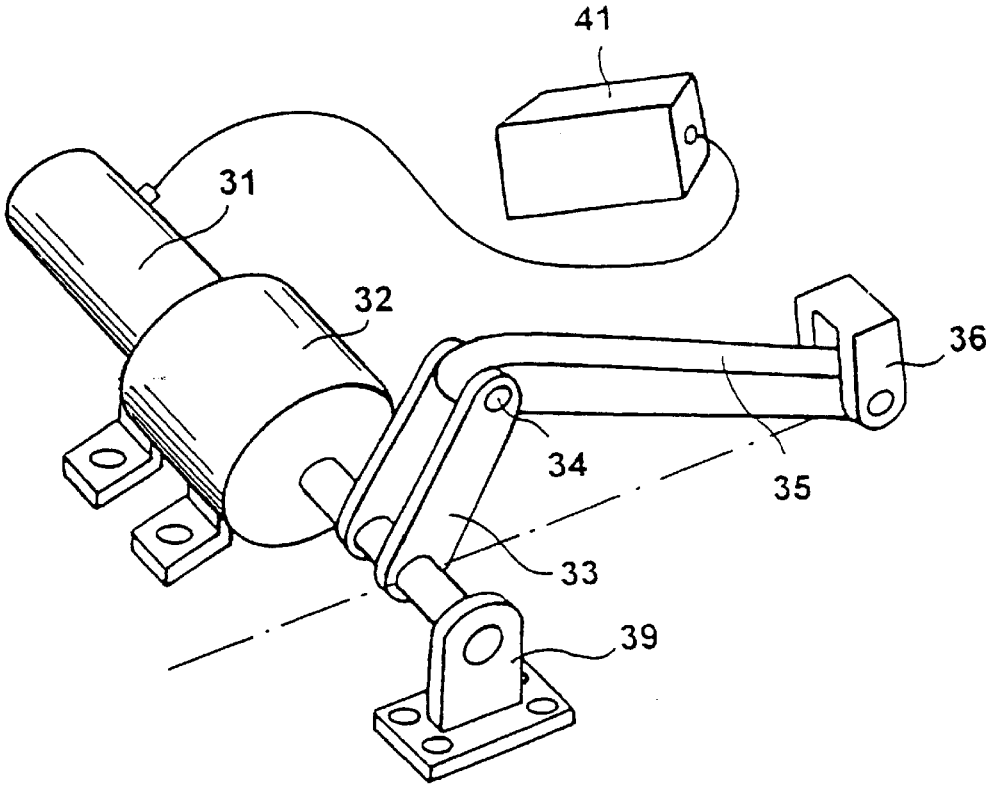
FIG. 4 is a schematic view of the adjusting means.

The functioning of the present invention is depicted in FIGS. 1–3. The suspension system 12 is not illustrated for reasons of clarity. In this preferred embodiment of the present invention, the hydraulic cylinders 27 and 28 and the linear actuators 29 and 30, respectively, are replaced by an electromotor 31, a reduction gear 32, and a crankshaft 33. The crankshaft 33 includes a crank pin 34 on which a drawbar and/or side rod 35 is pivotally fixed, thus forming a mechanism with an infinitely variable transmission. The electromotor 31 with the reducing gear 32 is attached to the bogie 3. The other end of the drawbar and/or side rod 35 is pivotably connected to the superstructure 2.

Figure 5:
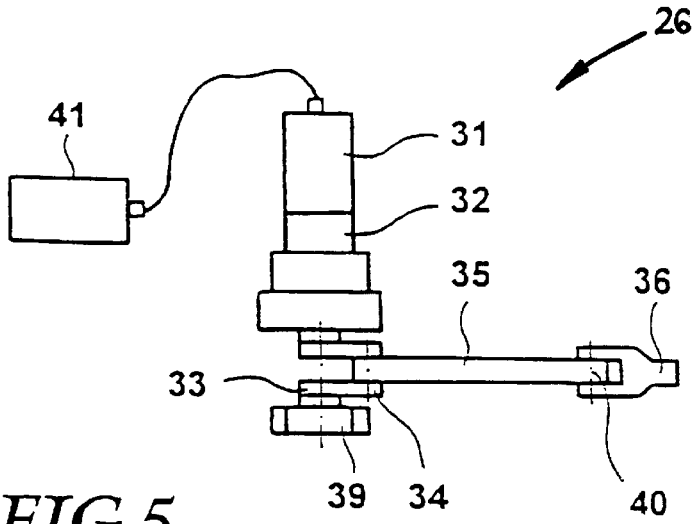
FIG. 5 is a horizontal projection of the adjusting means shown in FIG. 4.
Figure 6:
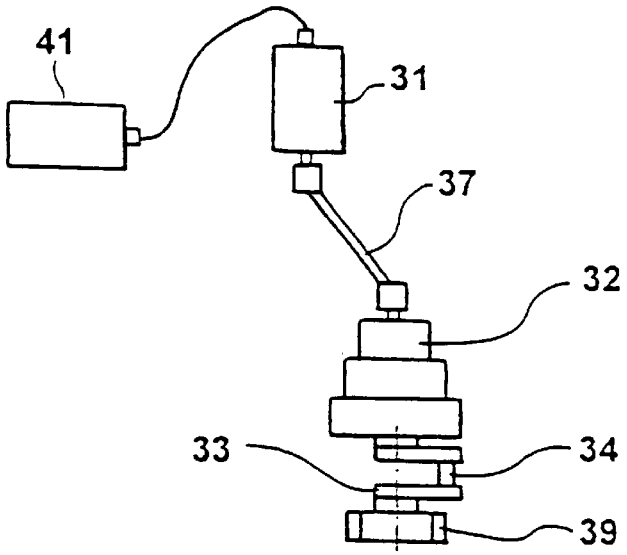
FIG. 6 is an alternative embodiment of the adjusting means, in the same projection as in FIG. 5.
Figure 7:
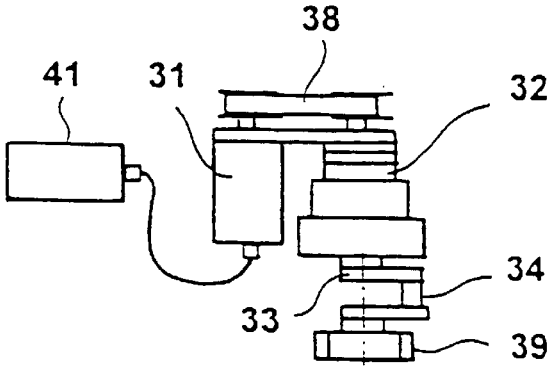
FIG. 7 is an alternative embodiment of the adjusting means, in the same projection as in FIG. 5.

FIG. 5 shows a top view of the adjusting means 26, the crankshaft 33 being pivotably supported by the reduction gear 32 on the one hand and by a swivel fixed pivot bracket 39 on the other hand. The swivel fixed pivot bracket 39 is not shown in detail for reasons of clarity in FIGS. 1–3. In alternative embodiments, the electromotor 31 may be connected to the reduction gear 32 either by means of an universal joint 37 or a belt drive 38, as shown in FIG. 6 and 7.

The drawbar and/or side rod 35 is jointly connected with the superstructure 2 via a swivel fixed pivot bracket and a crank pin 40.

The superstructure 2 is only schematically shown in FIGS. 1–3, wherein a carrier element 13 is shown as a substitute for the superstructure 2, the superstructure 2 being mounted onto the carrier element 13 which may also be part of the superstructure 2. In an initial position, the adjusting means 26 is preset in such a way that a line through the center of the crankshaft 33 and the crank pin 34 forms a more or less right angle together with a line through the crank pin 34 and the journal of the shaft 40. In a state of maximum excursion or tilting of the superstructure 2 relative to the bogie 3, respectively, the adjusting means 26 or the crank mechanism, respectively, is substantially aligned as can be seen from FIGS. 2–3. Controlling of the adjusting means 26 is made possible in the invention by a control device 41, by means of which the turning direction of the electromotor 31 can be controlled depending on the desired excursion. The maximum excursion value amounts to approximately 8 degrees as characterized by the angle $\alpha$ in FIG. 2.

Operation

In the initial position of the superstructure 2 relative to the bogie 3, the superstructure 2 is arranged more or less upright on the bogie 3. The superstructure 2 is in its initial position when cruising straight forward. In case the passenger train 1 enters a curve, the superstructure 2 relative to the bogie 3, may be infinitely tilted to a respective angle $\alpha$ depending on cruising velocity and radius of the curve towards the interior of the curve. Such a tilt for the superstructures is for example shown in FIG. 9 to 11. To reach such a tilt, the electromotor 31 is activated via the control device 41, thus transferring a turning movement of the motor shaft not depicted here by means of the reduction gear 32 to the crankshaft 33 which changes its initial state shown in FIG. 1 to a state depicted in FIG. 2 or 3, depending on the desired direction of inclination. A turning of the crankshaft 33 results in the drawbar and/or side bar 35 exerting a force on the carrier element 13 or the superstructure 2, respectively, causing it to tilt by the desired angle $\alpha$ relative to the bogie 3.

Figure 8A:
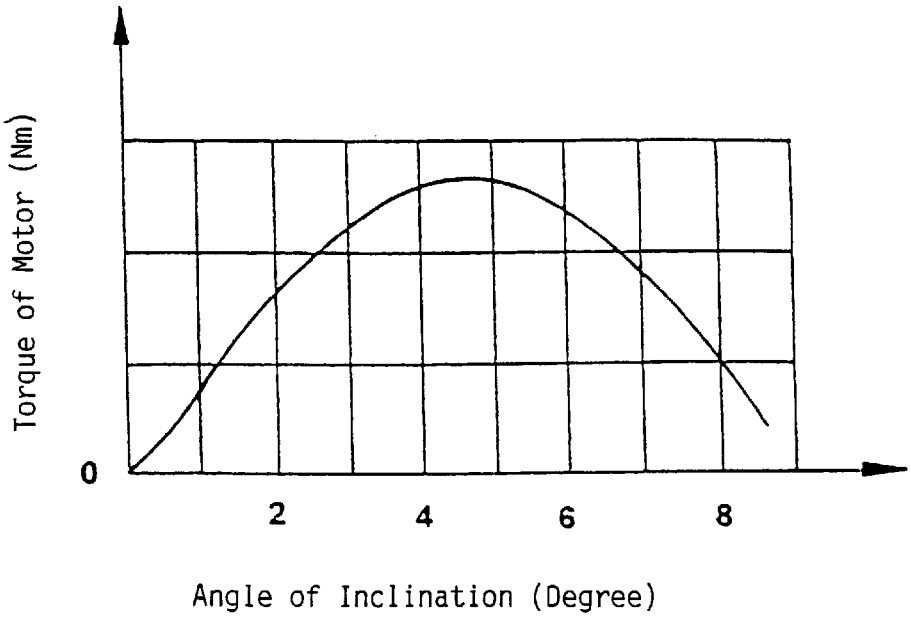
FIG. 8*a* is a diagram showing the progression of the torque relative to the angle of inclination.
Figure 8B:
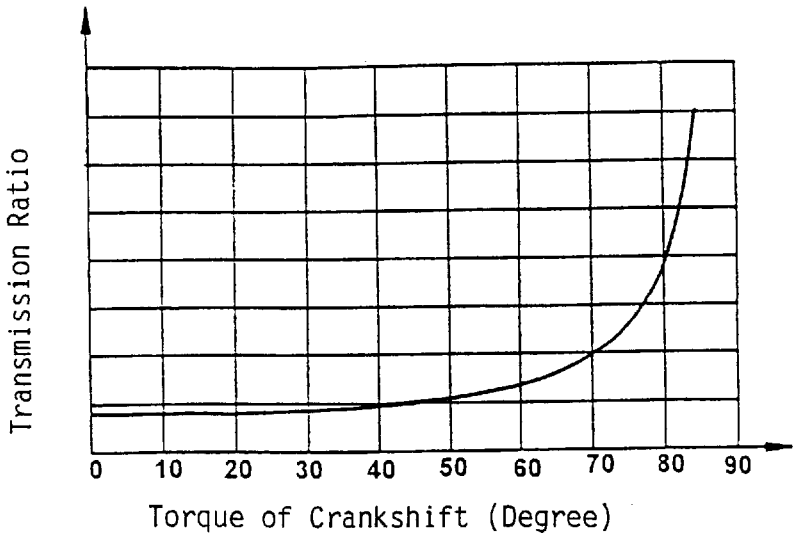
FIG. 8*b* is a diagram showing the transmission relative to the turning angle of the crank.

During initial excursion, the electromotor 31 requires a relatively low torque which progressively increases to a maximum value with increasing rotation of the crankshaft 33, followed by a later decrease. Close to the maximum excursion of the superstructure 2 relative to the bogie 3, the motor torque decreases despite increasing excursion forces due to the kinematic arrangement of crankshaft 33 and drawbar and/or side bar 35. The torque progression is schematically shown in FIG. 8*a*, the transmission ratio of motor torque angle relative to the inclination of the superstructure depending on the crank angles can be seen in FIG. 8*b*. The motor torque or the transmission ratio, respectively, is shown as a norm, since it changes according to the size of the superstructure 2 and other design factors. Important is only the progression of the motor torque at which a very low motor torque is necessary during maximum excursion. This aspect of the invention represents a major difference to conventional solutions in which the motor of the linear drive has to create a maximum torque in case of maximum angles of inclination.

The novel design of the tilting mechanism now enable tilting systems for predetermined loads to be equipped with electromotors with lower permanent output. The tilting mechanism on which the invention is based can be manufactured more inexpensively and can be designed for smaller spaces. It is also possible to displace the electromotor 31 relative to the reduction gear or the crankshaft 33 by including a universal joint 37 or a belt drive 38, respectively. This enables the tilting mechanism to be adjusted to the given installation situation in the bogie 3.

Modifications

The present invention contemplates that many changes and modifications may be made. The particular materials of which the various body parts and components parts are formed are not deemed critical and may be readily varied. The particular shape of the individual component body parts may be altered, modified or varied by a skilled designer, and one may envision a number of embodiments performing substantially the same function in a slightly different configuration.

What is claimed is:

1. In a tilting mechanism of a rail vehicle (1) having a superstructure (2), for creating a track curve-dependent tilting of said superstructure, said tilting mechanism including a coupling means (15) to which said superstructure and a bogie (3) are movably connected such that said superstructure can be transferred from a mainly upright initial position to a tilted position relative to said bogie, an adjustment means (26) by which said superstructure can be transferred from said initial position to said tilted position, said adjustment means having a transfer means and a drive (31), the improvement comprising:

said transfer means including a force transfer mechanism having a variable displacement transmission ratio, whereby said displacement transmission ratio increases with an increase in the inclination angle of said superstructure relative to said bogie when said superstructure is transferred from said initial position to said tilted position.

2. The tilting mechanism as set forth in claim 1, wherein said force transfer mechanism includes a crankshaft (33), said crankshaft having a crank pin (34) radially displaced relative to said crankshaft, and a drawbar (35) pivotably attached to said crank pin (34).

3. The tilting mechanism as set forth in claim 2, wherein said crankshaft and said drawbar are substantially aligned at a maximum inclination angle.

4. The tilting mechanism as set forth in claim 2, wherein, at said initial position, a first line drawn through the center of said crankshaft and the said crank pin forms a substantially right angle with a second line drawn through the center of said crank pin and a bearing position of the drawbar located distant to said crank pin.

5. The tilting mechanism as set forth in claim 2, wherein said drive is an electromotor (31).

6. The tilting mechanism as set forth in claim 5, wherein said electromotor (31) is attached to said bogie (3), and said drawbar (35) is attached to said superstructure (2).

7. The tilting mechanism as set forth in claim 5, wherein said electromotor is attached to said superstructure (2), and said drawbar is attached to said bogie (3).

8. The tilting mechanism as set forth in claim 1, wherein said drive is an electromotor (31).

9. The tilting mechanism as set forth in claim 8, wherein said transfer means includes a reduction gear (32) between said force transfer mechanism and said electromotor.

10. The tilting mechanism as set forth in claim 9, wherein said electromotor is connected to said reduction gear by a universal joint (37).

11. The tilting mechanism as set forth in claim 9, wherein said electromotor is connected to said force transfer mechanism by a universal joint.

12. The tilting mechanism as set forth in claim 9, wherein said electromotor is connected to said reduction gear by a belt drive (38).

13. The tilting mechanism as set forth in claim 9, wherein said electromotor is connected to said reduction gear by a chain drive.

* * * * *